United States Patent [19]

Rayburn

[11] Patent Number: 4,890,427

[45] Date of Patent: Jan. 2, 1990

[54] ROOFING FRAMEWORK

[76] Inventor: Lee W. Rayburn, 220 Olson Rd., Silverton, Oreg. 97381

[21] Appl. No.: 626,418

[22] Filed: Jun. 29, 1984

[51] Int. Cl.[4] ..... E04B 7/02

[52] U.S. Cl. ..... 52/90; 52/DIG. 11; 52/22

[58] Field of Search ..... 52/90, 92, 199, 299, 52/DIG. 11, 22

[56] References Cited

U.S. PATENT DOCUMENTS

| | | | |
|---|---|---|---|
| 2,214,183 | 9/1940 | Seymour | 52/199 X |
| 3,605,355 | 9/1971 | Solesbee | 52/90 |
| 3,727,354 | 4/1973 | Powell | 52/90 X |
| 3,791,082 | 2/1974 | Bowling | 52/90 X |
| 3,797,181 | 3/1974 | Nievelt | 52/199 X |
| 4,010,584 | 3/1977 | Barnes, Jr. | 52/299 |
| 4,261,149 | 4/1981 | Gustafson | 52/DIG. 11 X |
| 4,404,780 | 9/1983 | Josephson | 52/299 X |
| 4,423,572 | 1/1984 | Tor | 52/522 X |
| 4,435,926 | 3/1984 | Struben | 52/22 X |
| 4,546,579 | 10/1985 | Rionda et al. | 52/92 |
| 4,559,748 | 12/1985 | Ressel | 52/90 |
| 4,570,396 | 2/1986 | Struben | 52/90 |

*Primary Examiner*—Carl D. Friedman
*Assistant Examiner*—Creighton Smith
*Attorney, Agent, or Firm*—Charles N. Hilke

[57] ABSTRACT

A roofing framework for permanently mounting on top of mobile homes. Means of support are added under the mobile home. Cripple walls are used in a form of the invention to carry a portion of the roof load. The roofing framework remains permanently attached when the mobile home is moved. In another form of the invention, gussets are used and/or a scissors truss is used for the roofing framework.

8 Claims, 2 Drawing Sheets

ROOFING FRAMEWORK

BACKGROUND OF THE INVENTION

This invention relates generally to the construction of roofs to be added on to already constructed mobile home roofs. More specifically, the invention allows the use of an increased slope to the roof with subsequent increase life for composition shingles. Venting is provided by means of soffets and roof vents.

Prior to this invention, it was believed impractical to build a more solid roof structure because of the increase loads on the sidewalls of the mobile homes.

The use of trusses in the construction of mobile homes is well known in the prior art. See for example, U.S. Pat. No. 4,376,362; U.S. Pat. No. 4,245,449; and U.S. Pat. No. 3,875,650. Roof box frames are known in the prior art of construction. See for example U.S. Pat. No. 3,346,999; U.S. Pat. No. 3,364,646; and U.S. Pat. No. 4,228,631. The prior art does disclose a removable added roof structure for mobile homes. U.S. Pat. No. 3,982,360.

SUMMARY OF THE INVENTION

In this invention, additional blocking will be provided under the mobile home in the appropriate places as described further herein. In one form of the invention base plates are attached to the edge of the roof and cripple walls are attached at the top most point of the existing roof. The rafters are attached between the base plates and on top of the two cripple walls. Hurricane clips are used for the attachment of the rafters to the base plate and the cripple wall. Exterior plywood and composition shingles are used. The fan vents, attic vents, and plumbing vents, through the existing roof of the mobile home are extended to pass through the new roof. Insulation can be added on top of the old roof. Metal siding and soffets or T-111 plywood siding are added for cosmetic purposes.

It is an object of this invention to increase the life of mobile home roofs.

It is a further object of this invention to eliminate frequent roof coatings used on mobile homes.

It is another further object to eliminate leaks.

DRAWING DESCRIPTION

DETAILED DESCRIPTION OF THE INVENTION

Figure 1:
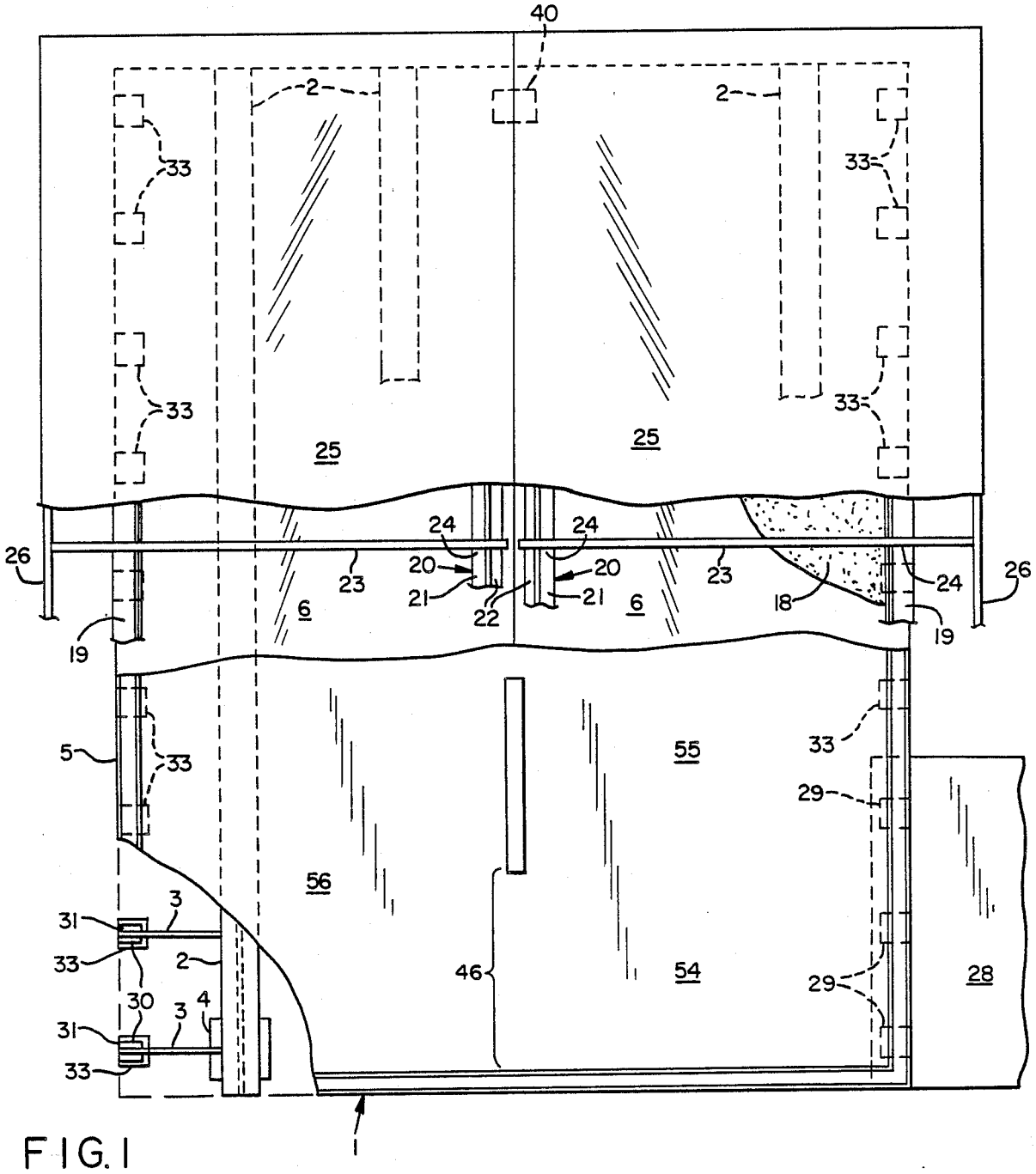
FIG. 1 is a cut-away top view of a mobile home with the additional blocking shown.

FIG. 1 shows a plan view with a portion of the roof sectioned. The mobile home 1 with the existing roof 6 is shown. The box beam 20 is shown. The opened span 46 is shown generally in the area of the kitchen 55, dining room 54, and living room 56. The solid pier blocking 33 is located on the base of the sidewalls 5. The rear solid pier block 40 is shown centered at the rear of the mobile home 1.

Figure 2:
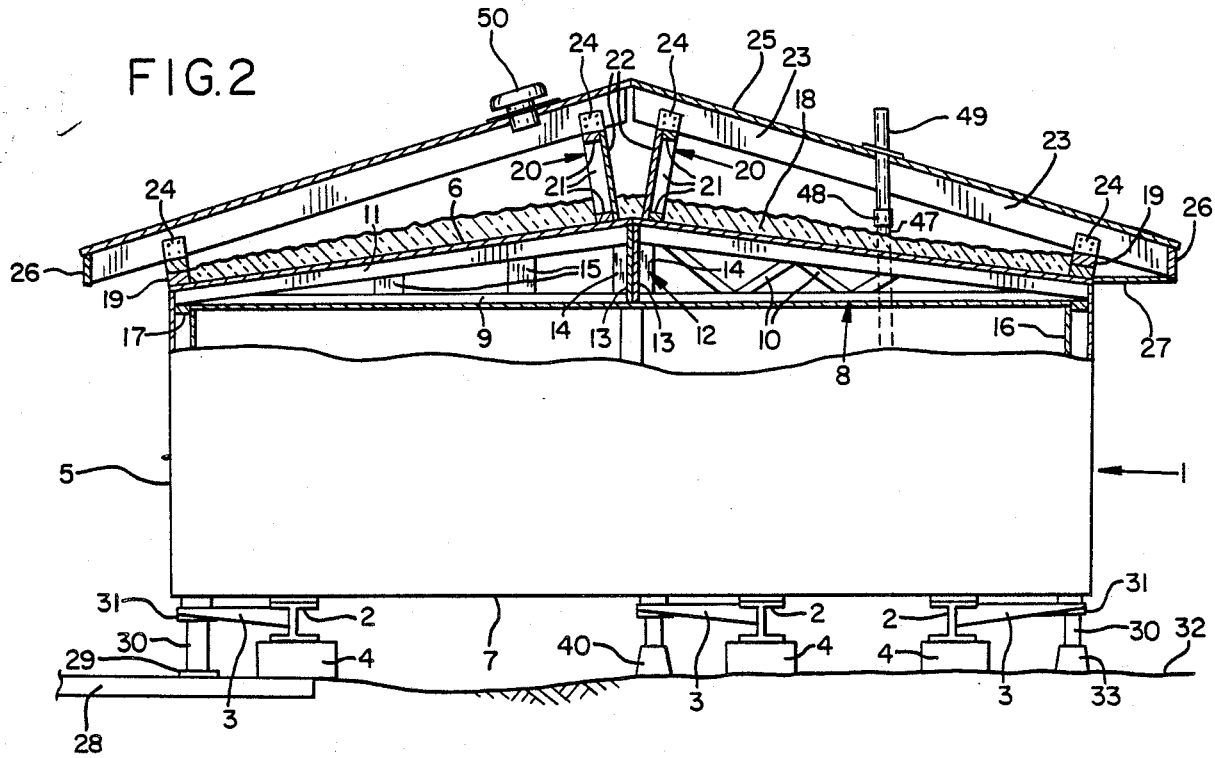
FIG. 2 is a general form of a double wide mobile home shown in a cross section.

FIG. 2 shows in cross-section the fully constructed new roof. The mobile home 1 which is a double wide, is supported on I beams 2. The I beams 2 are supported by existing pier blocks 4 which are generally 8" by 12" masonary blocks. Attached to the I beams 2 are outriggers 3. The sidewall 5 is connected to the existing roof 6, which is generally metal, and the floor 7. The existing roof 6 is supported by an existing truss 8 which generally consists of an existing cord 9, a truss rafter 11, tension braces 10, and a center beam 12 which is constructed from truss plywood 13 and center brace 14. In some mobile homes 1, the existing gussets 15 replaces the tension braces 10. A top plate 17 rests upon the stud wall 16. Insulation 18 is rolled over the existing roof 6. Base plate 19 is nailed to the top plate 17 through existing roof 6 and into stud wall 16. A box beam 20 is nailed through the existing roof 6 into the center beam 12. The box beam 20 consists of cripple wall 21 and box beam plywood 22. A common rafter 23 spans between the base plate 19 and the box beam 20. Hurricane clips 24 are used to attach the common rafter 23 to the base plate 19 and to the box beam 20. A composition roof 25 is then placed over the common rafters 23. Facia board 26 is attached to the ends of the common rafter 23 and soffets 27 span the distance from the end of the common rafters 23 to the sidewall 5 of the mobile home 1. Where a concrete slab 28 exist under the mobile home 1, a moisture barrier 29 is provided upon which a posts 30 communicates with a wedge 31 inserted between the outrigger 3 and the post 30. Where support is to be added to existing soil 32, a solid pier block 33 is placed on the soil. A moisture barrier is provided between the solid pier block 33 and the post 30. Attic vents 50 are provided and existing plumbing vent 47 communicates with the extension 49 by means of a coupler 48 through the composition roof 25.

Figure 3:
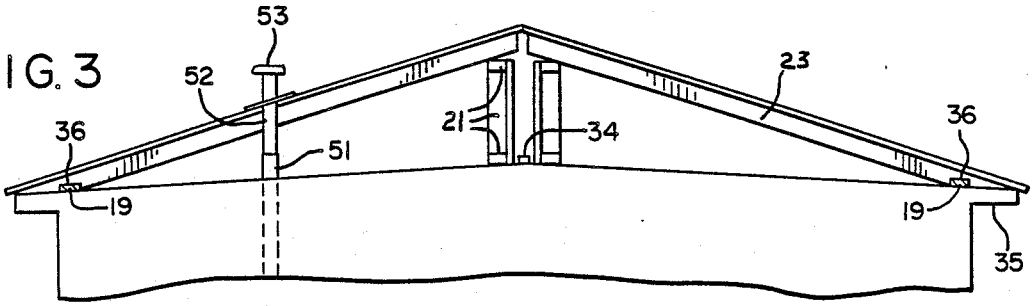
FIG. 3 is another general form of a double wide mobile home shown in cross section.

In FIG. 3, a mobile home 1 which is a double wide is shown where existing soffets 35 are built into the mobile home 1. In this case, the common rafter 23 requires a bird mouth cut out 36 to fit over the base plate 19. In addition, there is frequently a ridge cap 34. Also shown is an existing fan vent 51 with an extension fan vent 52 and a fan covering 53.

Figure 4:
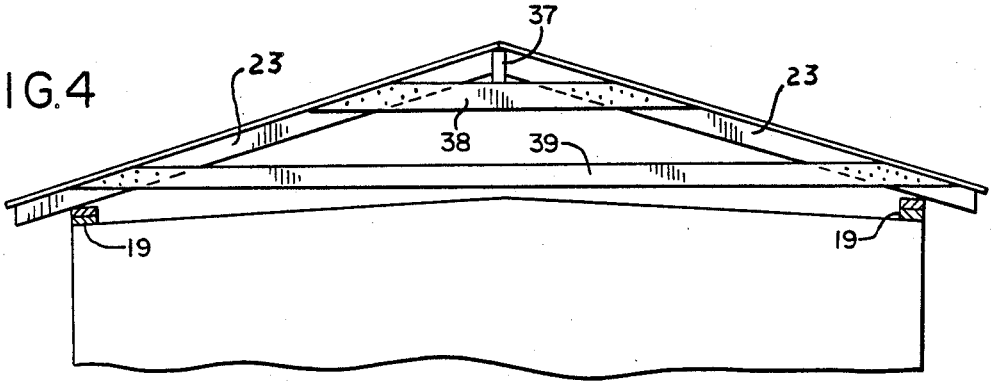
FIG. 4 is a single wide mobile home with gussets shown in cross section.

In FIG. 4, a mobile home 1 which is a single wide is shown. This construction requires a base 19 along with common rafters 23 jointed to a center ridge 37. The base of the center ridge 37 rests on plywood cross tie gusset 38. Cross tie 39 joins the lower portion of the common rafter 23 together.

Figure 5:
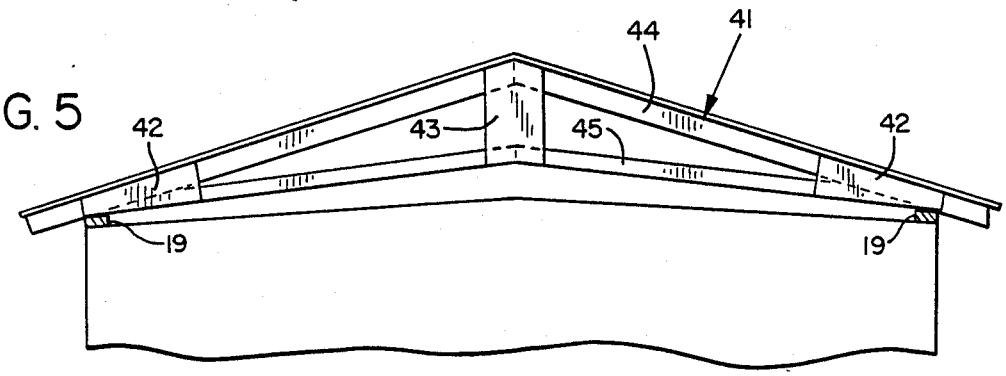
FIG. 5 is a scissors truss for a single wide mobile home shown in cross section.

Finally, FIG. 5 shows a scissors truss 41 for a mobile home 1 which is a single wide. The scissors truss 41 rests upon base plates 19. The scissors truss 41 is comprised of a scissors rafter 44 and a scissors cord 45 joined by a scissors support gusset 43 and by a pressure treated cleat 42.

In construction, the base plates 19 are attached through the existing roof 6 to the top plate 17 and the stud wall 16 by 16 penny galvenized nails. The box beam 20 is next constructed with the cripple wall 21 having vertical members spaced 24 inches on double wides and 16 inches on double wides which are 28 feet in width. The height of the box beam is adjusted so that the pitch of the roof is either 3 in 12 or 4 on 12. This is to assure the mobile home height will be capable of movement on highways. The height limitation is 14.6 feet. All joints of the cripple wall 21 and the box beam plywood 22 are staggered to increase the strength of the box beam 20. The box beam plywood 22 is added to one side of the box beam 20 only. The box beam 20 is then placed on each side of the highest center point of the existing mobile home roof 6 and nailed through the existing mobile home roof 6 to the center beam 12. The next step is to place the couplers 48 on existing plumbing vents 47. The insulation 18 is next placed on the existing roof 6. The common rafters 23 are attached by the hurricane clips 24 to the base plate 19 and the box beam 20. The common rafters 23 are set two feet apart on double wides except in the case of the 20 foot double wide where they are set at 16 inches. The rafters 23 are placed over the cripple wall vertical 2 × 4's of the cripple wall 21. The hurricane clips 24 are used on every other common rafter 23 at the base plate 19 but are used on every rafter at the box beam 20. The composition roof 25 is then prepared in the usual fashion using plywood with staggered joints. The holes are prepared in the plywood for the existing plumbing vent 47, the attic vents 50 and the existing fan vents 51. The pipes are extended and felt is laid on the plywood and then the composition shingles are laid in the usual manner. At this point the solid pier blocks 33 are placed through the rim of the mobile home 1. In addition, rear solid pier block 40 is added to the rear of the mobile home 1 in the center. After this has been accomplished the gable ends are enclosed and the cosmetic touches with the addition of soffets 27 are added if necessary.

In FIG. 3, the additional step of making the bird mouth cut out 36 is required. However, neither soffets 27 nor hurricane clips 24 need to be added at the base plate 19. The height of the cripple wall 21 is increased to achieve either the 4 and 12 or 3 and 12 pitch.

In FIG. 4, a 14 foot single wide mobile home 1 is shown. The length of common rafter 23 is at its limit in this particular instance. A center ridge 37 is added which rests upon the plywood cross tie gusset 38. A cross tie 39 is added between the lower portions of the common rafter 23. Hurricane clips 24 are again used on the common rafters 23 attached to the center ridge 37 and the base plate 19.

In FIG. 5, the scissors truss 41 is used. The scissors truss 41 is attached to the base plate 19 with the hurricane clips 24. Again this mobile home is a single wide. The advantage of the scissors truss 41 is the speed at which the roof apparatus may be constructed.

Throughout the United States, different zones have been devised regarding the amount of roof loads each mobile home must withstand. Those regions toward the northern part of the United States must stand higher roof loads than those towards the southern parts of the United States. Generally, mobile home roofs are either 20 pound or 30 pound roofs. If the mobile home roof is a 30 pound roof, it is not necessary to perform the solid pier blocking 33 as shown.

While the description contained herein as related to mobile home roofs, it is apparent that this structure may be used on permanent flat roof structures.

While the invention has been described in detail with reference to the appended drawings, it is to be understood that changes and variations may be made without departing from the spirit and scope of the invention as set forth in the appended claims.

I claim:

1. A mobile home roof apparatus comprising:

a. an existing mobile home roof to which are attached base plates;

b. two box beams attached upon the existing mobile home roof located on a center beam;

c. hurricane clips attach common rafters to the said box beam and said base plates;

d. a composition roof attached on said common rafters;

e. solid pier blocks upon which posts and wedges support mobile home outriggers; and f. a rear solid pier block.

2. The mobile home roof apparatus of claim 1 wherein said box beams comprise:

g. a cripple wall; and h. box beam plywood.

3. The box beams of claim 2 wherein said box beams are placed side by side with box beam plywood facing each other.

4. The box beams of claim 2 wherein a joint in said cripple wall and a joint in said box beam plywood are staggered.

5. The mobile home roof apparatus of claim 1 where said common rafters include a bird mouth cut-out for said base plates.

6. The mobile home roof apparatus of claim 1 further comprising:

i. coupler;

j. extension;

k. attic vents;

l. extension fan vent, and m. van covering.

7. The mobile home roof apparatus of claim 1 further comprising insulation on said existing mobile home roof.

8. The method of constructing a mobile home roof apparatus comprising the following steps:

a. attaching base plates to an existing mobile home roof;

b. constructing box beams comprising a cripple wall and box beam plywood where a joint in said cripple wall and a joint in said box beam plywood are staggered;

c. attaching said box beams by nailing upon the existing mobile home roof on the center beam where said box beams are placed side by side with box beam plywood facing each other;

d. hurricane clips attached common rafters to said box beam and said base plates;

e. constructing a composition roof on said common rafters;

f. placing solid pier blocks upon which posts and wedges support the mobile home outriggers;

g. placing a read solid pier block at the center of the mobile home.

* * * * *